United States Patent [19]

Graves, Jr.

[11] Patent Number: 4,724,850

[45] Date of Patent: Feb. 16, 1988

[54] PROCESS FOR PROVIDING TOBACCO EXTENDER MATERIAL

[75] Inventor: William H. Graves, Jr., Pfafftown, N.C.

[73] Assignee: R. J. Reynolds Tobacco Company, Winston-Salem, N.C.

[21] Appl. No.: 826,462

[22] Filed: Feb. 5, 1986

[51] Int. Cl.[4] ..... A24B 3/14

[52] U.S. Cl. ..... 131/370; 131/372; 131/375

[58] Field of Search ..... 131/370–375

[56] References Cited

U.S. PATENT DOCUMENTS

| | | |
|---|---|---|
| 1,068,403 | 7/1913 | Maier . |
| 2,708,175 | 5/1955 | Samfield et al. . |
| 2,734,509 | 2/1956 | Jurgensen . |
| 2,845,933 | 8/1958 | Samfield et al. . |
| 2,971,517 | 2/1961 | Pihl . |
| 3,053,259 | 9/1962 | Parmele et al. . |
| 3,076,729 | 2/1963 | Garbo . |
| 3,203,432 | 8/1965 | Green et al. . |
| 3,209,763 | 10/1965 | Parmele et al. . |
| 3,404,690 | 10/1968 | Mosby et al. . |
| 3,404,691 | 10/1968 | Mosby et al. . |
| 3,410,279 | 11/1968 | Mosby et al. . |
| 3,499,454 | 3/1970 | Hind . |
| 3,821,959 | 7/1974 | Schmidt . |
| 3,865,120 | 2/1975 | Detert et al. . |
| 3,932,081 | 1/1976 | Buchmann et al. . |
| 3,986,515 | 10/1976 | Egri . |
| 4,109,663 | 8/1978 | Maeda et al. . |
| 4,111,211 | 9/1978 | Hincklieff et al. . |
| 4,164,948 | 8/1979 | Beringer et al. . |
| 4,236,538 | 12/1980 | Foster et al. . |
| 4,325,391 | 4/1982 | Schmidt . |
| 4,347,855 | 9/1982 | Lanzillotti et al. . |
| 4,391,285 | 7/1983 | Burnett et al. . |
| 4,497,331 | 2/1985 | Nellen . |
| 4,510,950 | 4/1985 | Keritsis et al. . |
| 4,542,755 | 9/1985 | Selke et al. . |
| 4,598,721 | 7/1986 | Stiller et al. . |
| 4,625,737 | 12/1986 | Keritsis et al. . |
| 4,646,764 | 3/1987 | Young et al. . |

FOREIGN PATENT DOCUMENTS

| | | |
|---|---|---|
| 1532042 | 12/1977 | Fed. Rep. of Germany . |
| 3312159 | 10/1984 | Fed. Rep. of Germany . |

*Primary Examiner*—V. Millin

[57] ABSTRACT

Tobacco extender material is provided in strand form by contacting tobacco material and/or carbonized material in substantially dry form with a binding agent in substantially dry form, and then subjecting the mixture to a high rate of shear agitation in the presence of a relatively low moisture content. The material so processed is further processed using dry forming techniques in order to provide strands of reconstituted tobacco material and strands of carbonized material. The strands of tobacco extender are useful in the manufacture of cigarettes.

28 Claims, 4 Drawing Figures

PROCESS FOR PROVIDING TOBACCO EXTENDER MATERIAL

BACKGROUND OF THE INVENTION

This invention relates to methods for making tobacco products, and in particular, to methods for making reconstituted tobacco products and other tobacco extender materials under conditions of relatively low moisture levels.

When tobacco leaf is processed for use in smoking products and when tobacco products are manufactured, a substantial amount of scrap or waste tobacco is provided. Scrap or waste tobacco can be in the form of tobacco dust (typical particle size is less than about 60 Tyler mesh), tobacco fines (typical particle size is between about 20 Tyler mesh and about 60 Tyler mesh), tobacco stems, or processed tobacco which remains unused after tobacco product manufacture is interrupted or completed. As scrap or waste tobacco frequently is of high quality, it is highly desirable to reclaim or reconstitute such scrap or waste tobacco. For example, it is desirable to provide reclaimed or reconstituted tobacco in sheet or strand form, and to blend the reclaimed or reconstituted tobacco with tobacco leaf or cut filler in order to provide a resultant cut filler. The resulting cut filler is used in the manufacture of cigarettes (eg., in the manufacture of cigarette rods).

Various methods for providing reclaimed, reformed, reassembled or reconstituted tobacco are known. For example, tobacco materials can be mixed with relatively large amounts of water, processed, and dried. U.S. Pat. No. 1,068,403 discloses a process for the production of so-called artificial tobacco leaves by which tobacco veins are mixed with water in order to form a pulp, and the pulped veins are further processed. However, the method disclosed in U.S. Pat. No. 1,068,403 requires the use of relatively large amounts of water and undesirable subsequent drying steps.

U.S. Pat. No. 3,053,259, discloses another method for reclaiming tobacco fragments or tobacco fines. For example, tobacco material is ground to a very small size using a hammer mill or ball mill; the ground tobacco is moistened or mixed with a binder; and filamentary shreds are press formed or molded by passing the resulting mixture between a smooth surface roller and a grooved roller. However, the disclosed method requires the pre-grinding of material as well as the use of relatively large amounts of moisture, especially when a binder is not employed.

Other known methods for reclaiming tobacco material typically involve contacting tobacco material with binder and slow mixing the mixture using ribbon mixing devices or tumbling drums usually in combination with relatively great amounts of heat and/or moisture. However, it would be desirable to reclaim tobacco material in a fairly rapid fashion without the necessity of applying relatively large amounts of moisture and/or heat.

As there is a need for a process for regenerating tobacco waste products, it would be highly desirable to provide an efficient and effective process for providing tobacco extender such as reclaimed tobacco in the form of a strand. In particular, it is desirable to provide tobacco extender such as reclaimed tobacco using a process which requires neither the use of a relatively large amount of water and subsequent post drying of product, nor the application of external heat, nor lengthly processing steps.

SUMMARY OF THE INVENTION

In one aspect, this invention is a process for providing tobacco extender in strand form, said process comprising the steps in combination (a) providing tobacco material, carbonized material or blend thereof (hereinafter referred to as "filler material"), and (b) providing in essentially dry, substantially non-binding form, binding agent which is capable of being activated, and (c) contacting the filler material and the binding agent, and then (d) subjecting the filler material and binding agent to high shear agitation (i) in the presence of sufficient moisture to provide activation of the binding agent but in the presence of a moisture content of less than about 30 weight percent based on the total weight of moisture and filler material, and (ii) for a period of time sufficient to activate the binding agent, and then (e) forming strands of tobacco extender from the filler material so subjected to high shear agitation.

In another aspect, this invention is a process for providing tobacco extender in strand form, whereby a flavorant is incorporated into the filler material so subjected to high shear agitation.

In a preferred aspect, this invention is a process for providing tobacco extender in strand form, said process comprising forming strands of tobacco extender from the filler material so subjected to high shear agitation by (i) passing the filler material through the nip of a first pressurized roller system having two rollers exhibiting a nip zone pressure sufficient to provide compression of said filler material thereby providing compressed, admixed filler material, wherein at least one of the roller faces comprises a series of grooves, the series extending longitudinally along the roller and each groove extending about the periphery of the roller, wherein each groove has a maximum width near the surface of the roller and a minimum width near the bottom of the groove, and then (ii) forming under pressure strands of tobacco extender by passing the compressed, admixed filler material through the nip of a second pressurized roller system having two rollers exhibiting a nip zone pressure sufficient to provide the tobacco extender.

In a more preferred aspect, this invention is a process for providing tobacco extender in strand form, said process comprising forming under pressure reclaimed tobacco extender by passing the aforementioned compressed, admixed filler material through the nip of a second pressurized roller system having two rollers exhibiting a nip zone pressure sufficient to provide strands of tobacco extender wherein at least one of the roller faces of the rollers comprises a series of grooves, the series extending longitudinally along the roller and each groove extending about the periphery of the roller, wherein each groove has a maximum width near the surface of the roller and a minimum width near the bottom of the groove, and wherein each of the grooves has a maximum width and depth sufficient to provide tobacco extender; and then removing the tobacco extender from the face of the roller of the second pressurized roller system, said roller comprising the aforementioned series of grooves.

Surprisingly, the invention allows for the reclamation of tobacco in an efficient and effective manner in a short period of time using a process which requires neither relatively large amounts of moisture nor relatively large amounts of binder. Depending upon factors such as the binding agent used, the process of this invention can be performed at or near ambient temperatures without the necessity of the application of external heat. If desired, the process of this invention can be performed without chemical or physical pretreatment of the tobacco.

The strands of reclaimed tobacco extender and strands of tobacco extender incorporating carbonized material can be employed as is known in the art. For example, the tobacco extender material provided by the process of this invention can be dried, treated with additives, blended with other tobacco products, etc. The resulting tobacco extender is most useful in the manufacture of cigarettes.

DETAILED DESCRIPTION OF THE EMBODIMENTS

Figure 1:
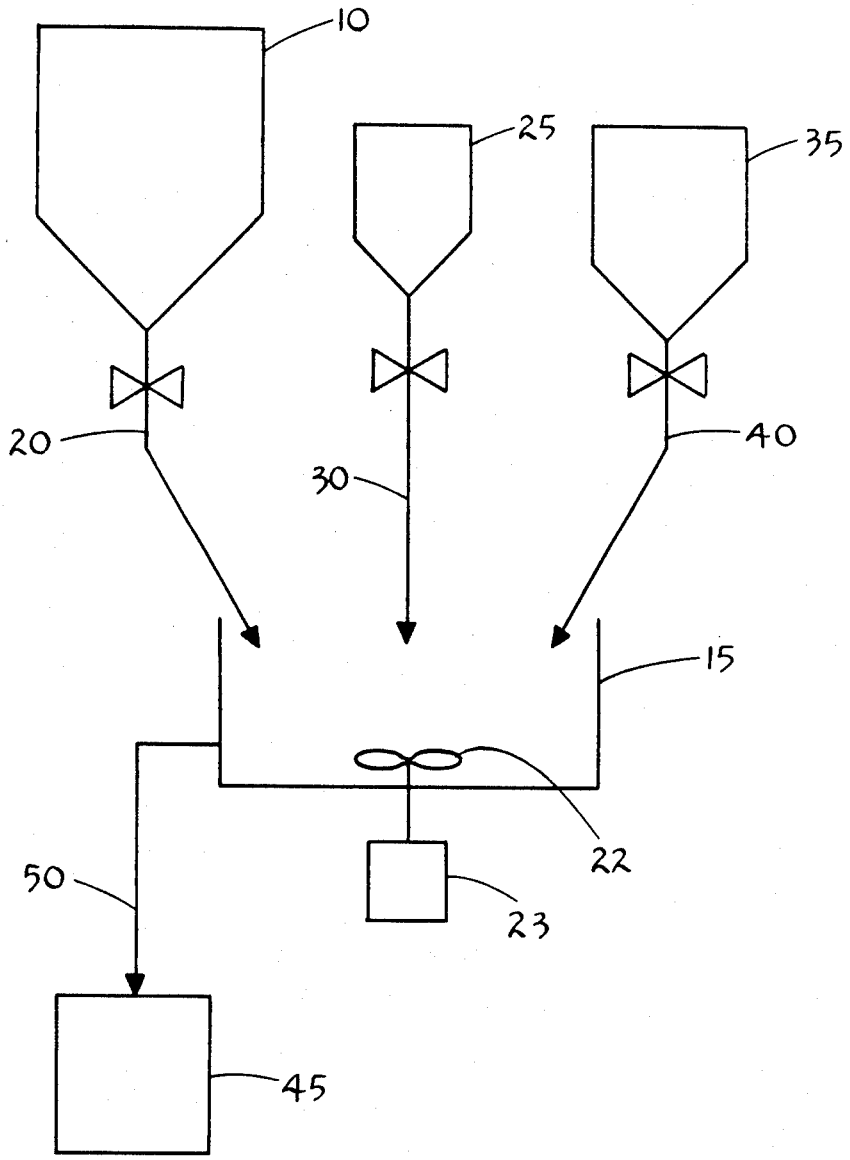
FIG. 1 is a schematic diagram of one embodiment of the processing steps of this invention.

In FIG. 1, container 10 is a storage bin, crate, vessel, hopper, or the like containing tobacco material, carbonized material, or combination thereof. For purposes of this invention tobacco material, carbonized material and blends thereof are collectively referred to hereinafter as "filler material." Filler material present in container 10 is transferred to mixing apparatus 15 (described in detail hereinafter) by way of conveying means 20 such as a conveyor belt, a transfer line, simple pouring or dumping device, or the like. Generally, the mixing apparatus is a high shear device having a shearing means 22 such as blades, knives, or the like, and a power source 23 for powering said shearing means. Container 25 is a transfer vessel, drum, or the like containing binding agent (described in detail hereinafter) which can be transferred to the mixing apparatus by way of conveying means 30 such as a conveyor belt, a transfer line, simple pouring or dumping device, or the like. Container 35 is a transfer vessel, drum, or the like containing moisture in the form of water which can be transferred to the mixing apparatus by way of transfer means 40 such as transfer line, simple pouring or dumping device, or the like. The amounts and type of filler material, binding agent and moisture and the method of transfer thereof to the mixing apparatus are described in further detail hereinafter. The filler material, binding agent and moisture are subjected to high shear agitation in the mixing apparatus, and the resulting filler material is transferred to strand forming apparatus 45 (described in detail hereinafter) by way of conveying means 50 such as a transfer line, convey belt, simple pouring or dumping device, or the like. The strand forming apparatus provides a means for further processing the filler material using dry forming techniques in order to provide strands of tobacco extender.

The tobacco material useful in this invention can vary and typically includes tobacco dust, tobacco fines, tobacco laminae, scrap tobacco which is recovered from various processing stages and cigarette manufacture stages, scraps and/or sheets of wet formed reconstituted tobacco (for example in dry form), scraps and/or sheets of dry formed reconstituted tobacco, tobacco leaf stems, and tobacco stems and stalks. The sizes of the various pieces or particles of tobacco material employed as filler material are not particularly critical. Various types of tobaccos and blends thereof can be employed as tobacco material according to this invention.

Carbonized material useful in this invention can vary and typically includes carbonized organic materials including carbonized wood (eg., oak, hickory, and other hardwoods) such as in the form of chips or sawdust, carbonized pieces of coconut shells, carbonized tobacco stems and stalks, carbonized peanut shells, carbonized oak leaves, and the like. Typically carbonized materials are materials derived from cellulosics and have a low inorganic content. Carbonized materials are provided using generally known techniques such as heating the material in a closed or inert (e.g., nitrogen) atmosphere. Carbonized materials employed in this invention can be in the form of particles having a range of sizes, typically ranging from powder or dust to stem like pieces of about 2 inches by about 0.25 inch. No pre-grinding of the carbonized material is necessary for use in the process of this invention. The carbonized material can be employed as filler material in a form wherein all particles are substantially equal in size, or in a form wherein the particles have a range of sizes.

As used herein the term "tobacco extender" is meant to include the resulting material in strand form which is provided according to the process of this invention. The tobacco extender can be provided from tobacco material and/or carbonized material. For example, tobacco material and carbonized material can be blended and employed as filler material in the process of this invention. The amount of tobacco material relative to carbonized material can range from 0 weight percent to 100 weight percent tobacco material, and from 100 weight percent to 0 weight percent carbonized material. When blends of tobacco material and carbonized material are employed, it is preferable to provide from about 25 to about 75 percent tobacco material and from about 25 to about 75 percent carbonized material, based on the total weight of the blend.

A binding agent (i.e., binder) is employed in the process of this invention and is most preferably a binding agent which is capable of being water or moisture activated. Examples of suitable binding agents include carboxymethylcellulose, sodium carboxymethylcellulose, carboxyhydroxy methylcellulose, guar gum, carragrenan gum, xanthan gum, locust bean gum, hydroxeylthyl amylose, tobacco extracts, sodium alginate, a binder sold commercially as Bermocoll E270G by Berol Kemlab, and the like, as well as combinations thereof such as a blend of carboxymethylcellulose and guar gum, or a blend of xanthan gum with locust bean gum.

The amount of binding agent which is employed relative to the filler material can vary depending upon factors such as the type of binding agents, the moisture content of the filler material, the temperature at which the filler material and binding agent are subjected to the high rates of shear agitation, and other such factors. Typically relatively low amounts of binder are employed. It is most preferable to employ less than about 15 weight percent, most preferably less than about 10 weight percent binding agent, based on the total weight of binding agent, moisture and filler material dry weight.

The filler material and binding agent are contacted and subjected to a high rate of shear agitation. The manner in which the filler material and binding agent are contacted can vary and is not particularly critical. For example, the filler material and binding agent each can be added bulk-wise to the apparatus which provides the high rate of shear agitation. Preferably the binding agent is employed in a substantially dry form when contacted with the substantially dry filler material, the binding agent is dispersed (e.g., mixed) with the filler material, and any moisture which may be necessary is then added to the filler material either prior to or during high shear agitation of the filler material.

As used herein the term "high rate of shear agitation" is meant to include that agitation which is sufficiently high in order to provide activation of the binding agent which is contacted with the filler material in a relatively short period of time without the necessity of subjecting the filler material and binding agent to temperatures significantly greater than ambient temperature and without the necessity of subjecting the filler material and binding agent to moisture greater than about 30 weight percent, based on the total weight of filler material and moisture. Typical high agitation rates exceed about 800 rpm, and preferably exceed about 1100 rpm as determined for a commercially available Hobart HMC-450 mixing device. The high rates of agitation can provide very rapid movement of the shearing means such as knives, blades, paddles, propellors, and the like. The time period over which the filler material and binding agent are subjected to the high rate of shear agitation can vary and can be as long as desired, but typically is less than about 10 minutes, more preferably between about 3 minutes and about 6 minutes. Typically the filler material and binding agent are subjected to the high rate of shear agitation at a temperature in the range from about 65° F. to about 110° F., although other temperature ranges can be employed. It is believed that the high rate of shear agitation provides good dispersion of the binding agent relative to the filler material, and that the shear agitation provides shear energy which may provide activation of the binding agent.

As used herein the term "activation" in referring to the binding agent is meant to include the introduction of the latent adhesive properties to the binding agent. Such introduction of adhesive properties can be provided by application of heat, moisture, pressure, shear energy, or the like. In particular, the binding agent loses its substantially dry character and behaves substantially as an adhesive which is capable of adhering the filler material together. The filler material which has been subjected to high shear agitation according to this invention generally exhibits a formable, somewhat consistent character and can be somewhat tacky in nature.

High rates of shear agitation can be provided using an apparatus such as a high intensity mixer, a homogenizer, a blender, a high shear extruder, or other high shear device. For example, from about 50 g to about 300 g of filler material can be subjected to high shear mixing using a commercially available Waring Blender set at medium speed for about 5 minutes or high speed for about 3 minutes, while periodically scrapping the sides of the mixing container with a device such as spatula in order to minimize cavitation of filler material and promote adequate thorough mixing. As another example, from about 1 kg to about 7 kg of filler material can be subjected to high shear mixing using a commercially available Hobart HMC-450 Mixer having the timer set at high speed for about 5 minutes. As another example, a high shear extruder providing the necessary shearing such as can commercially available single or double screw extruder can be employed.

The moisture content of the filler material can vary. Typically, a low moisture content filler requires a relatively greater amount of force in order to ultimately provide strands of tobacco extender materials; while a high moisture content requires the undesirable and energy intensive drying processes attendant in conventional water based reconstituted tobacco processes. Typically, the filler material which is employed at some stage in the process steps of this invention exhibits a moisture content of at least about 12 weight percent, preferably at least about 15 weight percent; while the upper limit of the moisture content is less than about 30 weight percent, and typically is as great as about 25 weight percent, preferably as great as about 18 weight percent, based on the dry weight of the filler material and total moisture. Typically, higher amounts of moisture permit the use of lower amounts of binding agent. Most preferably, the moisture content of filler material is not increased above about 18 weight percent prior to the time that the filler material and binding agent contacted and blending thereof is commenced. It is believed that moisture imparts a softening of tobacco material as well as providing a material having a pliability sufficiently low to allow for the utilization of a desirable force during the tobacco extender forming process. It is desirable that the moisture content not be overly high as to require excessive drying of the resulting tobacco extender, or as to cause an undesirable pliability of filler material and provide a tobacco extender of relatively poor tensile strength.

The process of this invention provides an efficient and effective means for incorporating water and/or temperature sensitive flavorants into the tobacco extender. For example, certain flavorants such as tobacco extracts, vanillin, chocolate, licorice, and the like can be blended with the filler material, binding agent and/or moisture. As the process of this invention can be performed at ambient temperatures the desirable characteristics of the flavorants are not lost due to degradation or chemical transformation caused by high temperatures. In addition, as the process of this invention is performed using relatively low moisture levels and relatively low amounts of liquid water are removed from the processed filler material, only relatively small amounts of moisture sensitive and/or water soluble flavorants are lost during processing stages.

Figure 2:
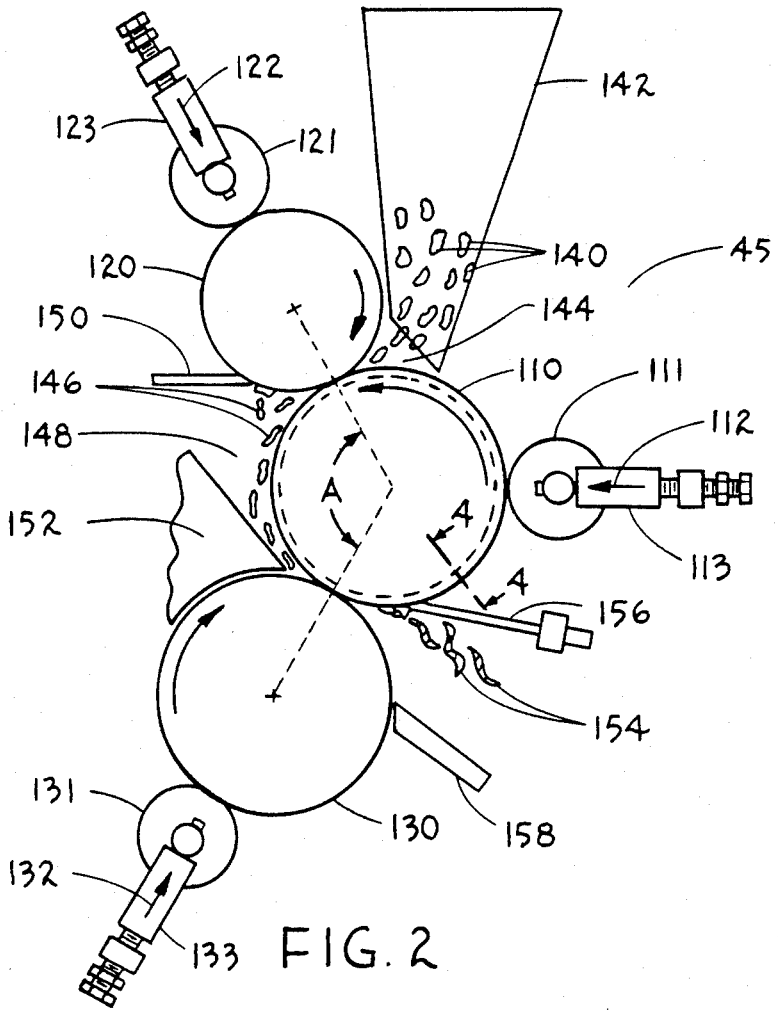
FIG. 2 is a diagrammatic illustration of one embodiment of a portion of the process of this invention showing the two pressurized roller systems and filler material processed to reclaimed strand form tobacco extender material.
Figure 3:
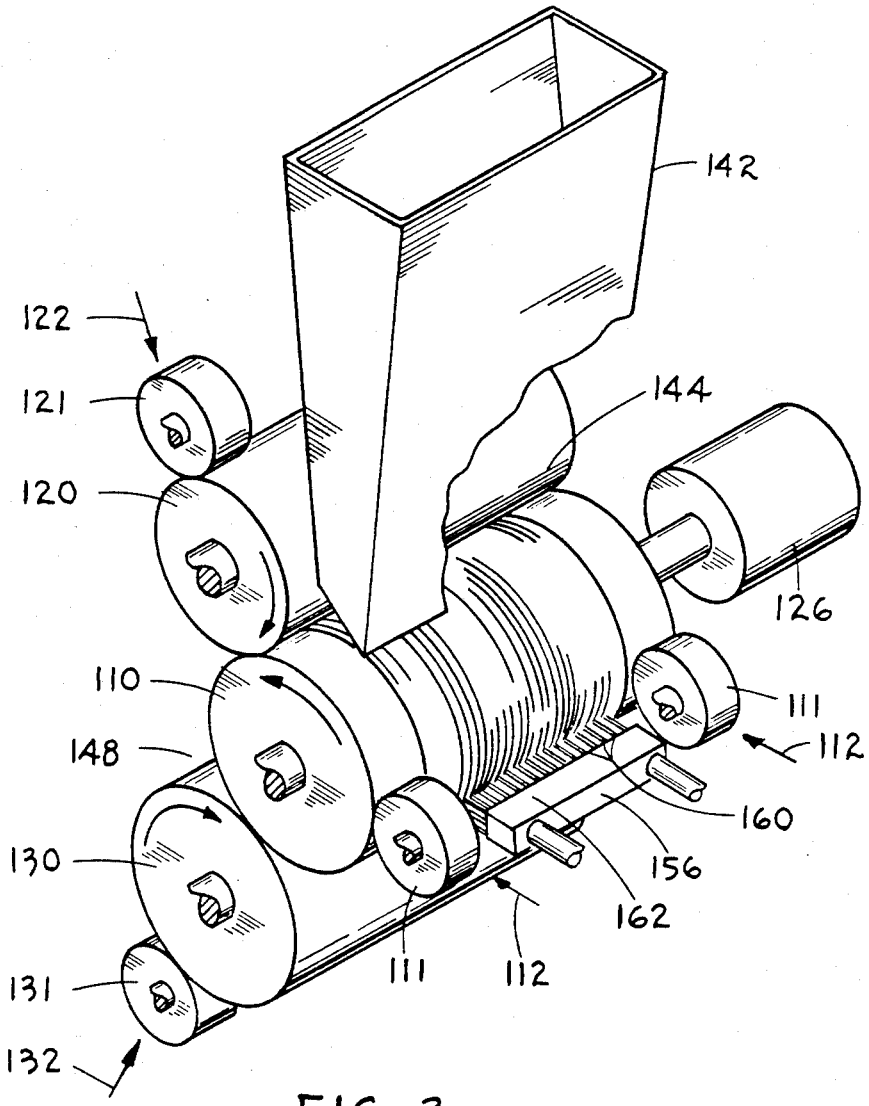
FIG. 3 is a perspective of an apparatus useful in the process of this invention showing the preferred pressurized roller systems and the means for removing reclaimed tobacco material from the roller face of a roller of the second pressurized roller system.

FIGS. 2 and 3 illustrate a strand forming apparatus 45 useful for conducting a portion of the process of this invention. The strand forming apparatus which is illustrated is particularly useful for providing strands from filler material, binding agent and optional flavorant which have been subjected to high shear agitation using a high shear mixing device. The strand forming apparatus comprises a first pressurized roller system and a second pressurized roller system. As used herein, the term "pressurized roller system" means two rollers in roll contact and exhibiting a nip zone pressure sufficient to provide compression of tobacco material which passes therethrough into a more compressed form. The apparatus includes roller 110 which is a common roller to each of the first and second pressurized roller systems. The first roller system includes substantially cylindrical roller 110 and another substantially cylindrical roller 120 in roll contact with one another. By the term "roll contact" is meant that two rollers aligned with roll faces essentially parallel to each other have the roll faces thereof in contact with one another for a distance along the length of each roller, and whereby each roller is capable of being rotated about the longitudinal axis of each roller. Each of the rollers forming the first pressurized roller system are mounted such that the aforementioned roll contact of roller 110 with roller 120 is substantially maintained during the processing steps of the invention. Force is applied to each of roller 110 and roller 120 by compression rollers 110 and 120 respectively in roll contact with each of rollers 110 and 120. The force is provided in a direction shown schematically by arrow 112 and arrow 122, respectively. The force can be provided to rollers 111 and 121 by jack screws 113 and 123, respectively. Other force providing means include hydraulic cylinders, or the like. Alternatively, the force providing means can be compression springs, tension springs, or the like. Preferably, two compression rollers are positioned on each roller of the pressurized roller system and are positioned near both ends of the roller (as shown in FIG. 3). Typically, each of the two such compression rollers have diameters and a combined longitudinal length less than that of the roller with which the compression rollers are in roll contact. The force providing means is positioned on each compression roller. Each of rollers 110 and 120 are rotated in the direction indicated by the arrows within the rollers. The rollers are rotated in opposite directions relative to one another in order that the filler material can be passed through the nip of the rollers. Each of the rollers can be driven using a power source 126 (shown in FIG. 3) such as a variable speed motor (e.g. an electric motor having from about 1 to about 5 horsepower) which turns the rollers by a series of drive gears (not shown). The rollers are supported by support means such as a frame (not shown) to a chassis (not shown).

The second pressurized roller system includes roller 110 and another substantially cylindrical roller 130 in roll contact with one another. Each of the rollers forming the second pressurized roller system are mounted such that the aforementioned roll contact of roller 110 with roller 130 is substantially maintained during the strand forming process. Force is applied to each of roller 110 and roller 130 by compression rollers in roll contact with each of rollers 110 and 130, such as compression roller 111 and compression roller 131, respectively. The force is provided in a direction shown schematically by arrow 120 and arrow 132, respectively. The force can be provided to rollers 110 and 131 by jack screw 130. Other force providing means include hydraulic cylinders, or the like. Compression roller 131 and force providing means 133 are positioned as are the compression rollers and force providing means described hereinbefore. Alternatively, the force providing means can be compression springs, tension springs, or the like. Each of rollers 110 and 130 are rotated in the direction indicated by the arrows within the rollers. The rollers are rotated in opposite directions relative to one another in order that the processed filler material can be passed through the nip of the rollers. Each of the rollers can be driven using a power source 126 (shown in FIG. 3) which turns the rollers by a series of drive gears (not shown). The rollers are supported by support means such as a frame (not shown) to a chassis (not shown).

Rollers positioned relative to one another in the configuration shown in FIG. 2 form angle A which can be defined as that angle formed by the roll axis (i.e., the longitudinally extending axis) of each of rollers 120, 110 and 130, respectively. The value of angle A can depend upon a variety of factors including the diameters of the various rollers. Typically, angle A ranges from less than 180° to a limiting angle defined by the diameter of the rollers, and preferably ranges from about 90° to about 150°.

In the preferred embodiment shown in FIGS. 2 and 3, roller 110 contains the series of grooves extending longitudinally along the roller wherein each groove extends about the periphery of the roller, and rollers 120 and 130 (which are each in roll contact with roller 11) have substantially smooth (i.e., non grooved) roller faces. Alternatively, in another embodiment, rollers 120 and 130 each can have the previously described series of grooves extending longitudinally therealong, and roller 110 (which is in roll contact with each of rollers 120 and 130) can have a substantially smooth roller face.

When compression rollers are employed at each end of the roller system rollers in order to provide the required nip zone pressures to the roller systems, it is most preferable that the grooved roller have grooves positioned along the longitudinal length of the roller only in the region between the compression rollers (i.e., the roll ends are not grooved).

The forces between the rollers which typically are required in the process of this invention can vary, but are those forces which are great enough to generate sufficient roller nip zone pressures in order to provide ultimately tobacco extender such as reclaimed (i.e., reconstituted) tobacco materials in a strand form. That is, sufficient nip zone pressures are those sufficient to provide shearing, mixing, and forming of said tobacco material, and can be as great as is desired. Typically, forces between rollers of at least about 3,000, and as great as about 10,000, preferably about 4,000 to about 6,000 pounds per linear inch, are great enough to generate sufficient roller nip zone pressures.

Typically, the rollers are constructed of a metal material such as hardened carbon steel or hardened alloy steel, or other material sufficient to with stand the compressive forces. The sizes of the various rollers can vary. Typically, roller diameters range from about 3 inches to about 8 inches, preferably about 6 inches to about 8 inches; while roller lengths range from about 6 inches to about 12 inches, preferably about 8 inches to about 12 inches. Rollers forming the two roller systems can each have diameters which are equal, or the diameters of the various rollers can differ. Rotational roller speeds range, for example, from about 4 rpm to about 20 rpm.

Operation of the apparatus of FIGS. 2 and 3 involves feeding the activated filler material 140 (i.e., which has been subjected to high rates of shear agitation under conditions sufficient to provide activation of the binding agent) by hopper 142 (which is shown as partially cut away in FIG. 3) to feed zone 144 which in turn feeds the filler material to the nip of rollers 110 and 120. The mixed and pre-formed filler material 146 which passes through the first pressurized roller system and then is fed into zone 148 which feeds the filler material to the second roller system. The filler material exiting the first roller system can have a tendency to stick to the rollers, and the material can be removed from the rollers (particularly roller 120 as shown in FIGS. 2 and 3) by scrape 150. Scrape 150 can be a series of needles, a comb-like configuration, a corrugated metal sheet, metal finger-like materials, or a knife-like means such as a doctor blade positioned against the length of the face of the roller so as to remove (i.e., scrape) the tobacco material from the face of the roller. Most preferably, scrape 150 is positioned non-tangentially to the surface of the roller. For example, scrape 150 is positioned against the face of roller 120 circumferentially at a location on the surface of the roller within an arc of about 10° to about 45° relative to the point at which rollers 110 and 120 meet in roll contact. Preferably, the scrape is positioned substantially parallel (i.e., within an angle of about 15°) relative to the tangent of the rollers formed by the point of the roll contact of rollers 110 and 120. Scrape 150 is attached to the chassis or frame of the apparatus (not shown) in order to maintain the positioning thereof against the face of the roller. If desired, zone 148 can be employed as an auxiliary feed zone where filler material, particularly small particle size material such as tobacco dust and/or tobacco fines, can be added to the mixed and pre-formed filler material 146 exiting the first roller system into zone 148. In particular, the compressed, admixed filler material 146 can be contacted with tobacco dust and/or tobacco fines in zone 148. Zone 148 can include slide 152 which is a hopper, feed or other such means for directing filler material 146 in the second pressurized roller system. The filler material 146 in zone 148 which has been mixed and preformed under pressure in the first pressurized roller system is generally a macerated, ground or pressed filler material having some tobacco extender material character.

Filler material 146 is further formed under pressure into the desired strand form material by passing filler material 146 through a subsequent second pressurized roller system. In the preferred embodiment shown in FIGS. 2 and 3, roller 110 has the previously described series of grooves extending longitudinally therealong and is in roll contact with both of rollers 120 and 130. Thus, filler material 146 is passed through the nip of rollers 110 and 130. The tobacco extender material 154 exits the second roller and can be removed from the surface of roller using scrape 156. Scrape 156 is attached to the chassis or frame of the apparatus (not shown) in order to maintain the positioning thereof against the face of the roller. The tobacco extender material 154 can be directed from the apparatus by slide 158 or other removal means and then collected.

Tobacco extender material in strand form is removed from the grooved roller using scrape 156 having needles 160 extending into each of the grooves of that roller having the series of grooves extending therealong (as shown in FIG. 3). For example, needles positioned so as to extend into the groove can tend to assist in removing the tobacco material from the groove. Needles 160 are held in place by frame 162 (as shown in FIG. 3).

Scrape 156 is most preferably positioned non-tangentially to the roller. For example, for the preferred embodiment illustrated in FIG. 2, scrape 156 is positioned against the face of roller 11 about 10° to about 30° along the surface of the roller relative to the center of the roller from the point at which rollers 110 and 130 meet in roll contact. Preferably, the scrape is positioned substantially parallel (i.e., within an angle of about 15°) relative to the tangent of the rollers formed by the roll contact of rollers 110 and 130.

Figure 4:
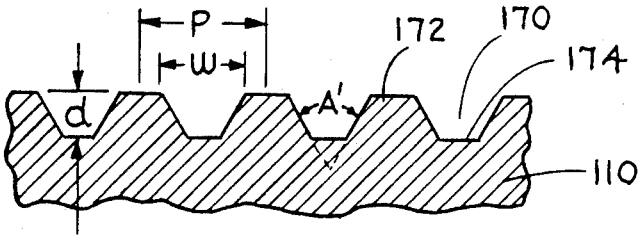
FIG. 4 is an enlarged, partial sectional view of of a roller taken along line 4—4 in FIG. 2 and showing a series of grooves, each groove extending circumferentially about the periphery of the roller.

FIG. 4 illustrates a series of grooves 170 each having a top portion 172 and a bottom portion 174. The series of grooves extend longitudinally along a portion of a roller designated as roller 110. The grooves 170 can be incorporated into roller 110 by techniques such as machining using a suitable lathe. Each groove completely circumscribes roller 110. Preferably each groove has a shape substantially similar to the other grooves which extend along the roller. The grooves can extend about the roller in a radial fashion, a helical fashion, or the like. Preferably, the grooves circumscribe the roller substantially transversely relative to the longitudinal axis of the roller. Top portion 172 can be, for example, pointed, or flattened (as illustrated in FIG. 4). When flattened, the top portion 172 typically ranges in width from about 0.010 inch to about 0.015 inch. Generally, the flattened top portion 172 is narrow enough so as to not require excessive force in order to maintain roller contact in the pressurized roller system; while flattened top portion 172 is wide enough as to not deform to a substantial extent under typical roller pressures. Bottom portion 174 can be pointed, rounded, or flattened (as illustrated in FIG. 4). When flattened, bottom portion 174 typically ranges in width from about 0.003 inch to about 0.007 inch. Generally, bottom portion 174 is sufficiently narrow so as to provide mixing action and increased compression of the filler material. Flattened bottom portion 174 is wide enough so as to permit the release of filler material from the surface region of the roller after processing. In particular, a bottom portion 174 which is overly narrow or pointed can tend to trap filler material in the groove and prevent release of the filler material therefrom. The depth d of the groove can vary and typically ranges from about 0.015 inch to about 0.035 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of filler material which is processed, the moisture content of said filler material, the shape of the groove, and the like. The pitch is defined as that lateral distance from the the center of top portion 172 to the center of the nearest adjacent top portion 172. Typically, a pitch of about 0.02 inch (i.e., about 1/50 inch) to about 0.06 inch (i.e., about 1/16 inch); preferably about 0.03 inch (i.e., about 1/32 inch) is useful for most applications. The shape of groove 170 can vary and depends upon a variety of factors. However, each groove has a maximum width near the surface of the roller and a minimum width near the bottom of the groove. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A′ of less than about 100°, can mix tobacco material suitably well; and a pressurized roller system having a roller comprising a series of grooves each having a sloping inner edge, each groove circumscribing an angle A′ of greater than about 45°, can release processed filler material suitably well. The preferred angle A′ is about 60° to about 90°, most preferably about 60°.

The tobacco extender material which is provided according to the process of this invention is provided generally in the form of a strand. Typically, the tobacco material in the form of a strand and when provided from tobacco material exhibits a structural strength which approaches that of cut filler. For example, the strand is substantially coherent in character and can be processed with cut filler in a cigarette making operation without the loss of substantial structural integrity. By the term "strand" as used herein is meant that the tobacco extender material is in a form wherein the length of said material is substantially greater than the width and thickness thereof. Typically, the thickness of the strand approximates that of cured or processed tobacco leaf. For example, the thickness of the strand ranges from about 0.005 inch to about 0.040 inch, preferably from about 0.025 inch to about 0.035 inch. The length of the strand can vary depending upon the means which is employed in forming the strand. The width can vary and typically approximates that of cut filler (i.e., most preferably about 32 cuts per inch). The thickness and width of the strand is most dependent upon the dimensions of the grooves of the rollers. The strand can be cut into lengths and employed as filler in the manufacture of cigarettes.

The following examples are provided in order to further illustrate various embodiments of the invention but should not be construed as limiting the scope thereof. Unless otherwise noted, all parts and percentages are by weight.

EXAMPLE 1

Strand form tobacco extender is provided from tobacco dust using the following procedure.

Into a Hobart-HMC-450 high shear mixer equipped with a stainless steel shaft and 2 metal blades each having lengths of about 8 inches is placed 1 kg (100 parts) of essentially dry tobacco dust collected from a cigarette making machine. To the container is placed essentially dry form binding agent in the form of 9 parts sodium carboxymethylcellulose and 5 parts guar gum. The tobacco dust and binding agent each have a moisture content of about 6 percent. The mixer is jogged for about 15 seconds in order to mix (i.e., blend) the binding agent and tobacco dust. The mixture of binding agent and dust resembles dry clay. The mixer is then run and 22 parts water is added to the container as mixing commences. The mixture is mixed at high shear agitation (i.e., about 1140 rpm) for about 5 minutes. The material so processed resembles slightly dampened clay. The resulting filler material which has been subjected to high shear agitation is processed further in order to provide strand form tobacco extender.

A strand forming apparatus which is generally described in FIGS. 2, 3 and 4 is provided. Roller 120 is constructed of hardened carbon steel, has a substantially smooth surface, and has a diameter of 5 inches and a roller face having a length of 8 inches. Roller 110 has a diameter of 5 inches and is of similar length and construction to roller 120; however, roller 110 contains grooves extending in a radial fashion about the periphery of said roller 110. Roller 110 comprises grooves in a 5 inch distance along the roller face, and the 1.5 inch distance along the roller face at each end of the roller is relatively smooth. Roller 110 is generally described in FIG. 4. The depth d of the grooves is about 0.0155 inch, the pitch p of each groove is about 0.03125 inch, and the angle A′ is about 60°. The top portion of each groove is flattened by a distance of about 0.01275 inch, and the bottom of each groove is flattened by a distance of about 0.006 inch. The rollers are operated using variable speed drive using a variable speed 1.5 horsepower electric motor at a speed of about 4 rpm, and a nip zone pressure of about 5000 pounds per linear inch is generated. Roller 130 is of similar size and construction to roller 120. Roller 130 is operated using a variable speed drive at a speed of 4 rpm, and nip zone pressure between each of roller 110 and roller 130 of 5000 pounds per linear inch is generated. The angle A provided by the central axis of roller 120, roller 110 and roller 130, respectively, is 90°. Scrape 156 in the form of needles is positioned so as to remove the reclaimed tobacco material from roller 110. Force is provided to each of rollers 110, 120 and 130 by two compression rollers positioned in roll contact with each of rollers 110, 120, and 130. Each compression roller is positioned at one end of each of rollers 110, 120 and 130. The compression rollers are about 1 inch in longitudinal length and about 2 inches in diameter. Force is provided to the compression rollers by jack screws.

The resultant blend is introduced into the apparatus and a reclaimed tobacco material in the form of strand is provided. The resulting strand has a generally triangular or trapezoidal shape and dimensions of about 1 inch to about 12 inches long, about 0.024 inch thick, about 0.012 inch to about 0.025 inch wide.

EXAMPLE 2

Strand form tobacco extender is provided from carbonized material using the following procedure.

Into the mixing container of the high speed mixer described in Example 1 is placed 1.5 kg (150 parts) essentially dry, powder form carbonized material which is sold commercially as Westvaco NuChar S.A. Wood Based Activated. To the container is placed essentially dry form binding agent in the form of 9 parts sodium carboxymethylcellulose and 5 parts guar gum. The mixer is jogged for about 15 seconds in order to mix the binding agent and carbonized material. The high shear mixer is then run and 20 parts water is added to the container as mixing commences.

The resulting filler material which has been subjected to shear agitation for about 5 minutes is processed using the pressurized roller system described in Example 1 in a manner substantially as described in Example 1. The resulting stand has a size and shape similar to the resulting strand described in Example 1, and exhibits good tensile strength and flexibility.

EXAMPLE 3

Strand form tobacco extender is provided from a blend of tobacco material and carbonized material using the following procedure.

Into the mixing container of the high speed mixer described in Example 1 is placed about 1.13 kg (113 parts) of essentially dry, powder form carbonized material described in Example 2, and about 37 parts Winnower throw tobacco stems from a Molins MK9 Cigarette Maker. To the container is placed essentially dry form binding agent in the form of 9 parts sodium carboxymethylcellulose and 5 parts guar gum. The mixer is run jogged for about 15 seconds in order to mix the binding agent and filler material. The high shear mixer is then run and 25 parts water is added to the container as mixing commences.

The resulting filler material which has been subjected to shear agitation for about 5 minutes is processed using the pressurized roller system described in Example 1 in a manner substantially as described in Example 1. The resulting stand has a size and shape similar to the resulting strand described in Example 1.

EXAMPLE 4

Strand form tobacco extender is provided from a blend of scrap tobacco (i.e., scrap from a cigarette making machine) using the following procedure.

Into the mixing container of the high speed mixer described in Example 1 is placed 0.5 kg (50 parts) Winnower throw stems from a Molins MK9 Cigarette Maker, 25 parts long ends and 75 parts tobacco dust from a cigarette making machine. To the container is placed 9 parts sodium carboxymethylcellulose and 5 parts guar gum. The mixer is run jogged for about 15 seconds in order to mix the binding agent and filler material. The high shear mixer is then run and 27.2 parts water is added to the mixer as mixing commences.

The resulting filler material which has been subjected to shear agitation for about 5 minutes is processed using the pressurized roller system described in Example 1 in a manner substantially as described in Example 1. The resulting stand has a size and shape similar to the resulting strand described in Example 1.

EXAMPLE 5

Strand form tobacco extender is provided from a blend of tobacco material, carbonized material and water soluble flavoring agent using the following procedure.

Into the mixing container of the high speed mixer described in Example 1 is placed about 1.13 kg (113 parts) tobacco dust collected from a cigarette making machine, about 32 parts of the carbonized material described in Example 2, and about 2 parts solid commercially available flavoring agent. To the container is placed 1.5 parts locust bean gum and 1.5 parts xanthan gum. The mixer is run jogged for about 15 seconds in order to mix the binding agent and filler material. The high shear mixer is then run and 25 parts water is added to the mixer as mixing commences.

The resulting filler material which has been subjected to shear agitation for about 5 minutes is processed using the pressurized roller system described in Example 1 in a manner substantially as described in Example 1. The resulting stand has a size and shape similar to the resulting strand described in Example 1.

EXAMPLE 6

Strand form tobacco extender is provided from tobacco material using the following procedure.

Into the mixing container of the high speed mixer described in Example 1 is placed 1.5 kg (150 parts) Winnower throw stems from a Molins MK9 Cigarette Maker and 30 parts spray dried tobacco extract. This mixer is run jogged for about 15 seconds in order to mix the binding agent and filler material. The high shear mixer is then run and 30 parts water is added to the mixer as mixing commences.

The resulting filler material which has been subjected to shear agitation for about 5 minutes is processed using the pressurized roller system described in Example 1 in a manner substantially as described in Example 1. The resulting stand has a size and shape similar to the resulting strand described in Example 1.

EXAMPLE 7

Strand form tobacco extender is provided from tobacco dust using the following procedure.

In a plastic bag is mixed 150 parts of essentially dry tobacco dust collected from a cigarette making machine, 1 part essentially dry xanthan gum, 1 part essentially dry locust bean gum and 10 parts water. The bag is hand shaken in order to provide an essentially homogeneous mixture of tobacco dust and binding agent. The mixture is removed from the bag and transferred to a vibrating hopper which feeds a twin screw extruder. The twin screw extruder comprises a constant pitch metal screw 16 inches long. The diameter of the screw is 1.5 inch and flights are positioned along the length of the screw at a 2 inch pitch. The twin screw extruder feeds into a pressurized roller system. The extruder and roller system is a modified, commercially available TS-10 Roll Press supplied by Material Processing Corporation, Amherst, Ill., USA. The modifications are performed to the rollers and described hereinafter. The tobacco material/binding agent mixture is passed through the screw extruder which is run at about 30 rpm using a 1.5 hp motor. The temperature within the barrel is stabilized at about 85° F. The mixture is passed from the extruder through a metal die having a rectangular die opening of 0.25 inch by 1.5 inch. The tobacco material and binding agent mixture which has been subjected to high shear is fed from the die directly through the nip of two rollers which are in roll contact and form a pressurized roller system. The rollers each are generally cylindrical and have a 6 inch diameter and a longitudinal length of 1.5 inch. The two rollers are held in roll contact using jack screws, and a separating force of 30,000 pound is generated between the rollers. One of the rollers has a substantially smooth roll face. The other roller is modified by machining in order to have a series of grooves extending along the length of that roller wherein each groove extends about the periphery of the roller substantially transversely to the longitudinal axis of the roller. A profile of the roll face of the grooved roller is generally described in FIG. 4. The depth of the grooves is about 0.017 inch, the pitch of each groove is about 0.036 inch and the angle A' is about 60°. The top portion of each groove is flattened by a distance (extending longitudinally along the roller) of about 0.013 inch, and the bottom portion of each groove is flattened by a distance (extending longitudinally along the roller) of about 0.003 inch. The rollers are operated at a roll speed of from about 10 to about 72 rpm.

Reclaimed tobacco material in strand form is provided from the tobacco material which passes through the rollers. Strands are providing by scraping the reclaimed material from the grooves of the grooved roller using series of needles which extend into each of the grooves.

EXAMPLE 8

Strand form tobacco extender is provided from tobacco material using the following procedure.

In a plastic bag is mixed 68 g locust bean gum, 68 g xanthan gum, 136 g glycerin, 4534 g tobacco material and 650 g water. The tobacco material is a blend of 40 parts tobacco fines, 30 parts tobacco dust and 30 parts Winnower Throw stems. The amount of water used is sufficient to provide a resulting mixture having a moisture content of about 25 percent. The bag is hand shaken in order to provide an essentially homogeneous mixture of tobacco material and binding agent. The mixture is removed from the bag and transferred to a vibrating hopper which feeds a twin screw extruder. The twin screw extruder comprises a constant pitch metal screw 16 inches long. The diameter of the screw is 1.5 inch, and the flights are positioned along the length of the screw at a 2 inch pitch. The twin screw extruder feeds into a pressurized roller system. The extruder and roller system is a modified, commercially available TS-10 Roll Press supplied by Material Processing Corporation, Amherst, Ill., USA. The modifications are performed to the rollers as described hereinafter. The tobacco material/binding agent mixture is passed through the screw extruder which is run at about 30 rpm using a 1.5 hp motor. The temperature within the barrel is stabilized at about 200° F. The mixture is passed from the extruder through a metal die having a rectangular die opening of 0.25 inch by 1.5 inch. The mixture which has been subjected to high shear is fed from the die directly through the nip of two rollers which are in roll contact and form a pressurized roller system. The rollers each are generally cylindrical, have a 6 inch diameter, and a longitudinal length of 1.5 inch. The two rollers are held in roll contact using jack screws, and a separating force of 30,000 pounds is generated between the rollers. One of the rollers has a substantially smooth roll face. The other roller is machined in order to have a series of grooves extending along the length of that roller wherein each groove extends about the periphery of the roller substantially transversely to the longitudinal axis of the roller. A profile of the roll face of the grooved roller is generally described in FIG. 4. The depth of the grooves is about 0.0125 inch, the pitch of each groove is about 0.036 inch, and the angle A' is about 90°. The top portion of each groove is flattened by a distance (extending longitudinally along the roller) of about 0.008 inch, and the bottom portion of each groove is flattened (or slightly rounded) by a distance (extending longitudinally along the roller) of about 0.003 inch. The rollers are operated at a roll speed of from about 10 to about 72 rpm.

Reclaimed tobacco material in strand form is provided from the mixture which passed through the rollers.

What is claimed is:

1. A process for providing tobacco extender in strand form, said process comprising the steps in combination (a) providing filler material in the form of tobacco material and/or carbonized material, and (b) providing in essentially dry, substantially non-binding form binding agent which is capable of being activated, and (c) contacting the filler material and the binding agent with one another, and then (d) subjecting the filler material and binding agent to high shear agitation (i) in the presence of sufficient moisture to provide activation of the binding agent but in the presence of a moisture content of less than about 30 weight percent based on the total weight of moisture and filler material, and (ii) for a period of time sufficient to activate the binding agent, and then (e) forming strands of tobacco extender from the filler material so subjected to high shear agitation.

2. The process of claim 1 wherein flavorant is incorporated into the filler material so subjected to said high shear agitation prior to forming strands of tobacco extender from the filler material so subjected to high shear agitation.

3. The process of claim 2 wherein said flavorant is water soluble and/or temperature sensitive.

4. The process of claim 1 wherein said strands of tobacco extender are formed from the filler so subjected to high shear agitation by (i) passing the filler material through the nip of a first pressurized roller system having two rollers exhibiting a nip zone pressure sufficient to provide compression of said filler material thereby providing compressed, admixed filler material, wherein at least one of the roller faces comprises a series of grooves, said series extending longitudinally along the roller and each groove extending about the periphery of the roller, wherein each groove has a maximum width near the surface of the roller and a minimum width near the bottom of the groove, and then (ii) forming under pressure strands of tobacco extender by passing the compressed, admixed filler material through the nip of a second pressurized roller system having two rollers exhibiting a nip zone pressure sufficient to provide the tobacco extender.

5. The process of claim 4 wherein said nip zone pressures range from about 3,000 pounds per linear inch to about 10,000 pounds per linear inch.

6. The process of claim 4 wherein the filler material so subjected to high shear agitation exhibits a moisture content between about 15 weight percent and about 18 weight percent, based on the dry weight of the filler material and total moisture.

7. The process of claim 1 wherein said strands of tobacco extender are formed from the filler so subject to high shear agitation by (i) passing the filler material through tho nip of a first pressurized roller system having two rolers exhibiting a nip zone pressure sufficient to provide compression of said filler material thereby providing compressed, admixed filler material, wherein at least one of the roller faces comprises a series of grooves extending along the longitudinal axis of the roller and each groove extends about the periphery of the roller, wherein each groove has a maximum width near the surface of the roller and a minimum width near the bottom of the groove, and then (ii) forming under pressure strands of tobacco extender by passing the compressed, admixed filler material through the nip of a second pressurized roller system having two rollers exhibiting a nip zone pressure sufficient to provide the tobacco extender, wherein at least one of the roller faces of the rollers comprises a series of grooves said series extending longitudinally along the roller and each groove extending about the periphery of the roller, wherein each groove has a maximum width near the surface of the roller and a minimum width near the bottom of the groove, and wherein each of the grooves has a maximum width and depth sufficient to provide tobacco extender, and then (iii) removing the tobacco extender from the face of that roller of the second pressurized roller system having the aforementioned series of grooves.

8. The process of claim 7 wherein each of said grooves is generally "V" shaped.

9. The process of claim 7 wherein said tobacco extender material is removed by a series of needles positioned in the grooves of the roller.

10. The process of claim 1 wherein the filler material so subjected to high shear agitation exhibits a moisture content between about 15 weight percent and about 18 weight percent, based on the dry weight of the filler material and total moisture.

11. The process of claim 10 wherein said filler material is tobacco material.

12. The process of claim 1 wherein the filler material so subjected to high shear agitation exhibits a moisture content between about 14 weight percent and about 25 weight percent, based on the dry weight of the filler material and total moisture.

13. The process of claim 12 wherein said filler material is tobacco material.

14. The process of claim 12 wherein the filler material so subjected to high shear agitation exhibits a moisture content between about 14 weight percent and about 25 weight percent, based on the dry weight of the filler material and total moisture.

15. The process of claim 14 wherein said filler material is tobacco material.

16. The process of claim 1 wherein said filler material is tobacco material.

17. The process of claim 1 wherein said filler material is carbonized material.

18. The process of claim 1 wherein said filler material is a combination of tobacco material and carbonized material.

19. The process of claim 1 wherein said binding agent is capable of being moisture activated.

20. The process of claim 1 wherein the amount of binding agent is less than about 15 weight percent, based on the total weight of binding agent, moisture and filler material dry weight.

21. The process of claim 1 wherein said filler material and binding agent are subjected to the high rate of shear agitation at a temperature in the range from about 65° F. to about 110° F.

22. The process of claim 1 wherein said filler material and binding agent are subjected to mixing prior to being subjected to high shear agitation.

23. The process of claim 1 wherein said high shear agitation is provided by a Hobart HMC-450 mixing device providing an agitation rate of greater than about 800 rpm for about 3 minutes.

24. The process of claim 1 wherein said high shear agitation is provided by a Hobart HMC-450 mixing device providing an agitation rate of greater than about 1100 rpm for about 3 minutes.

25. The process of claim 1 wherein said high shear agitation is provided by a screw extruder.

26. The process of claim 25 wherein the filler material so subjected to high shear agitation exhibits a moisture content between about 15 weight percent and about 18 weight percent, based on the dry weight of the filler material and total moisture.

27. The process of claim 25 wherein the filler material so subjected to high shear agitation exhibits a moisture content between about 14 weight percent and about 25 weight percent, based on the dry weight of the filler material and total moisture.

28. The process of claim 25 wherein said filler material is tobacco material.

* * * * *